United States Patent [19]

Paurat et al.

[11] 4,274,675

[45] Jun. 23, 1981

[54] SHAFT-SINKING APPARATUS WITH MILLING HEAD AND CENTRAL WORM CONVEYOR

[76] Inventors: Friedrich W. Paurat, Kasselweg 29, Wesel; Roland Paurat, Lippestrasse 32, Voerde 2, both of Fed. Rep. of Germany

[21] Appl. No.: 69,162

[22] Filed: Aug. 23, 1979

[30] Foreign Application Priority Data

Aug. 26, 1978 [DE] Fed. Rep. of Germany ..... 2837348
Nov. 8, 1978 [DE] Fed. Rep. of Germany ..... 2848349

[51] Int. Cl.[3] ..... E21D 1/03

[52] U.S. Cl. ..... 299/31; 175/94; 175/102; 299/56; 299/61

[58] Field of Search ..... 175/94, 95, 96, 102; 299/31, 56, 57, 61

[56] References Cited

U.S. PATENT DOCUMENTS

| | | | |
|---|---|---|---|
| 1,604,896 | 10/1926 | Foltz | 175/173 X |
| 2,250,671 | 7/1941 | Joy | 175/173 |
| 2,798,707 | 7/1957 | Kandle | 175/94 X |
| 3,379,264 | 4/1968 | Cox | 175/94 X |
| 3,965,995 | 6/1976 | Sugden | 175/94 X |

FOREIGN PATENT DOCUMENTS

| | | | |
|---|---|---|---|
| 801615 | 9/1958 | United Kingdom | 175/102 |

*Primary Examiner*—Ernest R. Purser
*Attorney, Agent, or Firm*—Karl F. Ross

[57] ABSTRACT

An apparatus for the sinking of a shaft in which a machine platform can be anchored against the wall of the incipient shaft and carries an orbiting tool for cutting away the floor of the shaft, thereby dumping the detritus into a pilot-bore hole continuously drilled by a pilot-bore unit. The latter has a head for advancing the pilot bore and is provided with a worm conveyor running centrally through the shaft to transfer the detritus to a bucket on a loading platform disposed above the main platforms and connected thereto for feed cylinders. The platforms have cylinder arrangements whereby they can be independently anchored to the vertical wall of the shaft.

14 Claims, 5 Drawing Figures

SHAFT-SINKING APPARATUS WITH MILLING HEAD AND CENTRAL WORM CONVEYOR

FIELD OF THE INVENTION

Our present invention relates to an apparatus for the sinking of shafts into ground and subterranean strata of all types and, more particularly, to improvements in a shaft-sinking apparatus.

BACKGROUND OF THE INVENTION

In the sinking of a shaft into the ground, e.g. for communication with or as a precursor of a tunnel, it is a common practice to preform the upper portion of the excavation and then introduce a shaft-sinking machine into this excavation to increase the depth thereof. Such an apparatus can have a platform which carries the working tools which can include milling cutters or the like for removing material from the floor or face of the shaft and thereby forming detritus which is carried out of the advancing shaft.

It is advantageous with such systems to provide a pilot bore at the center of the shaft to be sunk as an aid to the shaft-sinking operation.

The term "detritus" as used herein is intended to refer to all types of excavation debris, independent of its hardness, and ranging from large hard rock to soft clay materials.

Conventional apparatus of the aforedescribed type is intended to provide a central pilot bore and then to mill away the floor or face of the shaft of the entire cross section or diameter thereof with the detritus at least partly falling into the pilot bore.

Difficulties have been encountered because of the filling of the pilot bore with detritus, in further advancing or sinking the shaft and hence efforts have been made to overcome this disadvantage by slurrying the detritus in the pilot bore (hydraulic conveying) or the like.

Pneumatic conveying of the detritus has proved to be impractical in many cases because of the high energy demand and the inability to pneumatically convey heavy materials over long distances at reasonable costs. Hydraulic techniques have proved to be impractical in many applications, particularly where the shaft is to be sunk in a frozen substructure as is required in instances in which the shaft wall as it is advanced would not otherwise be self-supporting.

OBJECTS OF THE INVENTION

It is, therefore, the principal object of the present invention, to provide an improved shaft-sinking apparatus which overcomes disadvantages of earlier systems as mentioned.

Another object of the invention is to provide an apparatus which allows particularly deep shafts to be sunk without interference with the sinking process by detritus removed earlier from the face which must be cut away.

SUMMARY OF THE INVENTION

These objects and others which will become apparent hereinafter and attained, in accordance with the present invention, with a system in which a pilot-bore unit is provided on the machine platform and can be advanced into the floor of the shaft while a cutter unit on this platform orbits the pilot-bore unit to cut away the face around the pilot bore which is always advanced ahead of the cutting unit. According to the invention, the pilot bore cutting head is provided with a conveyor worm which passes upwardly through a central conveyor tube traversing the main platform and transferring the detritus to at least one further transport means on a loading platform positioned above the main or machine platform whereby the detritus is then carried out of the shaft.

According to a feature of the invention, the conveyor tube reaches upwardly through the loading platform which, like the main machine platform can be releasably anchored to the vertical wall of the shaft and is provided with a chute or apron discharging the detritus above the loading platform laterally into the further transport means, e.g. a bucket which can be raised from the shaft.

Alternatively, the conveyor tube of the pilot-bore unit can open into an intermediate worm conveyor which extends upwardly through the loading platform and discharges the detritus into such a bucket or other transport means.

According to the invention, moreover, the cutter unit which is located laterally of the pilot-bore unit and above the head of the latter, comprises a milling drum driven independently of the pilot-bore unit and orbiting the axis of the latter, operating in such a manner that the detritus passes into the pilot bore from which it is carried away by the conveyor worm of the pilot-bore unit.

In general, the conveyor tube is fixed in the main platform but passes with play through the loading platform which can be provided with means for adjusting the orientation of the conveyor tube and hence the pilot-bore unit.

In a system of the present invention, therefore, the pilot-bore head can form a blind bore which is continuously sunk below the level of the milled face of the shaft while the detritus is carried away above the base of this bore by the conveyor worm above the pilot-bore head. The detritus thus does not interfere with the sinking of the pilot bore.

While conveyor worms for solids are known, the system of the invention provides a unique function for them since the upward advance of the detritus provides a downward force on the pilot head and at the same time enables the conveyor to follow the pilot-bore head so that a downward sinking of the bore occurs simultaneously with the rise of the detritus from the drilling side. The pitch of the worm is so dimensioned with respect to the friction angle that the product rides upwardly with rotation of the worm. Since the friction angle may vary with the materials excavated, the individual worms can be releasable or interchangeable to provide the desired pitch for a particular worm. The centrifugal force presses the conveyor material against the inner wall of the conveyor tube.

According to a feature of the invention, the pilot-bore head has at least two flights forming a scoop arrangement for lifting the detritus into the mouth of the conveyor tube and these flights are formed with picks and with a particular configuration as described below such that comminution of the detritus can occur and the detritus can be transferred effectively to the conveyor tube.

The pilot-bore unit can be driven in various ways. For example, a drive can be provided directly in the pilot-bore head although preferably a pilot-bore shaft is connected to this head and is rotated by a drive remote therefrom. This drive can be mounted at the upward end of the conveyor tube.

When the pilot shaft is driven, it can be formed directly with the flights of the conveyor worm. Alternatively, the pilot shaft can pass through a hollow shaft upon which the flights of the conveyor worm are mounted so that the conveyor and the pilot head can be driven at the same or different speeds. In many cases most efficient transfer of materials and pilot-bore sinking operations will require different rotary speeds of the conveyor worm and the head.

While the system of the present invention can provide feed devices for the pilot-bore head as well as the feed devices for the milling drum in the direction of the regions to be cut away, the advance of both the milling drum and the pilot-bore head can be effected by gravity simply by allowing the main platform to slip downwardly in the shaft as cutting proceeds. However, for precision in shaft sinking, it has been found to be advantageous to provide both platforms with independent fluid-responsive cylinders adapted to independently anchor the platform to the vertical wall of the shaft. Further cylinders can interconnect the platforms for control of the shaft sinking operation and still other cylinders can be provided to control the orientation of the pilot-bore unit and especially the conveyor thereof.

The system of the present invention can be used with hydraulic slurrying of the detritus, especially when a step is formed by the milling drum to confine the liquid to the region of the pilot bore. Furthermore, the transfer of the detritus to the conveyor by the pilot-bore head is facilitated by forming the latter with lifting flights or ramps which operate in a propeller fashion and can be of a star or cruciform pattern with cutting edges of hard metal, although the particular configuration described below has been found to be preferable.

While it is advantageous to provide a separate drive for the orbiting movement of the milling drum, this orbiting motion can be derived from the drum rotation itself. In either case the drum should be radially shiftable to vary the diameter of the shaft formed. The system can also be provided with auxiliary devices, for example, for the addition of lime when clayey structures are encountered.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
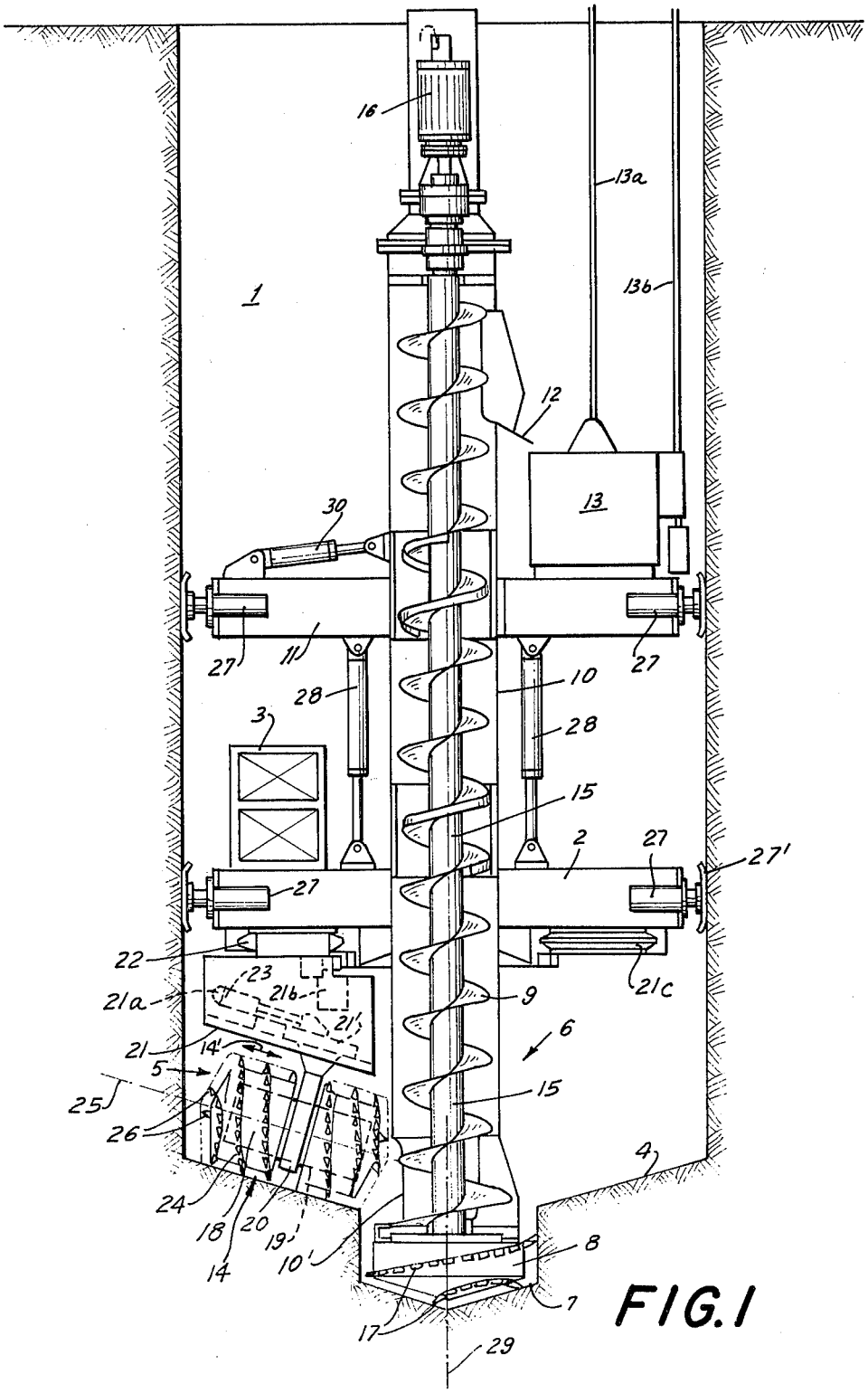
FIG. 1 is a partial vertical section in diagrammatic form illustrating a first embodiment of the invention.

From FIG. 1 it will be apparent that the shaft-sinking apparatus of the previous invention, which is adapted to be positioned in a previously formed subterranean shaft 1 to sink the latter, comprises a machine platform generally represented at 2, a drive assembly 3 mounted on this platform for operating a cutting unit 5 adapted to cut away the floor or face of the shaft 4 and a boring unit 6 adapted to form a central bore 7 below the face which is cut away by the unit 5.

In accordance with the principles of the invention, the cutting unit may be of the conveyor-cutting type and/or the base of the shaft to be cut away can be inclined downwardly and centrally to the bore 7 so that the detritus formed by the cutting unit 5 passes into the bore 7 which always is sunk to a lower level than the face 4 which is being cut. The detritus can thus pass into this bore and can be conveyed therefrom.

According to the invention, moreover, the boring unit 6 comprises a pilot-bore head connected to a conveyor worm 9 which rises centrally in a conveyor tube 10 passing through the machine platform 2 substantially to or above a loading platform 11.

The conveyor tube 10 is provided with a loading chute or apron represented at 12 or some like guide device for directing the upwardly conveyed detritus to a discharge device such as an elevator bucket 13 which can be raised and lowered by a cable 13*a* via a winch (not shown) while being guided by a cable 13*b*. In this manner the detritus can be lifted from the shaft and dumped in the usual manner.

A boring unit 6 and its pilot-boring head 8 thus generates a blind bore which is advanced ahead of the shaft sinking tool 5 continuously or, in any event, at the rate of advance of the sinking tool.

The sinking head 5 itself comprises a milling cutter 14 with helical flights of teeth or picks which, upon rotation of the drum 14, cut away the face of the shaft and convey the detritus downwardly and inwardly to the pilot bore 7. The drum 14 is provided with a respective drive and is mounted on a carriage so as to be radially displaceable relative to the vertical axis of the shaft along its axis 25 which is inclined downwardly and inwardly to the shaft axis 29. The miller 14, moreover, is mounted, as described below, to orbit the axis 29 and thereby operate upon the entire face 4 of the shaft.

In the embodiment of FIG. 1 and in accordance with the preferred embodiment or best mode embodiment of the invention, the pilot-bore unit comprises a pilot bore shaft 15 upon which the flights forming the conveyor 9 are mounted and which is surrounded by the conveyor tube 10. The latter can carry a drive represented at 16 and, for example, in the forming of an electric motor as has been illustrated diagrammatically in this FIGURE. Since the conveyor worm is mounted upon the shaft 15, it is rotated therewith. It is possible to provide still a further drive between the boring head 8 and the shaft 15 if the boring head is to rotate at a speed different from that of the tool 9.

In another possible modification, not shown in FIG. 1, the shaft 15 which carries the boring-head 9 can extend centrally through the hollow shaft bearing the flights of the conveyor 9, the two shafts being rotated by respective drives or a single drive whose output is split to these shafts, located at the top of the conveyor tube 10. In any of the cases mentioned, the pilot-bore head shaft 15 can be driven with the same or a different speed from that of the conveyor 9 and, in addition, the head 8 itself may be rotated at the same speed as, or a different speed from that of the conveyor 9.

When different speeds are to be generated, the two elements can be connected to separate drive motors 60, 61 (see FIG. 4) and gears, or by respective branches of a transmission 50 to a common drive motor 51 (see FIG.

3). When a transmission is used, it should preferably be of the speed-ratio change type.

The pilot-bore head 8 is formed as a milling head with picks or teeth which may be spirally or helically positioned as represented at 7 to form a conveyor for lifting the detritus formed by the head 8 or dumped into the bore 7 into the tube 10, e.g. through an opening 10' laterally thereof, or through the open lower end of the tube 10, to carry the detritus upwardly into the path of the conveyor 9.

Figure 2:
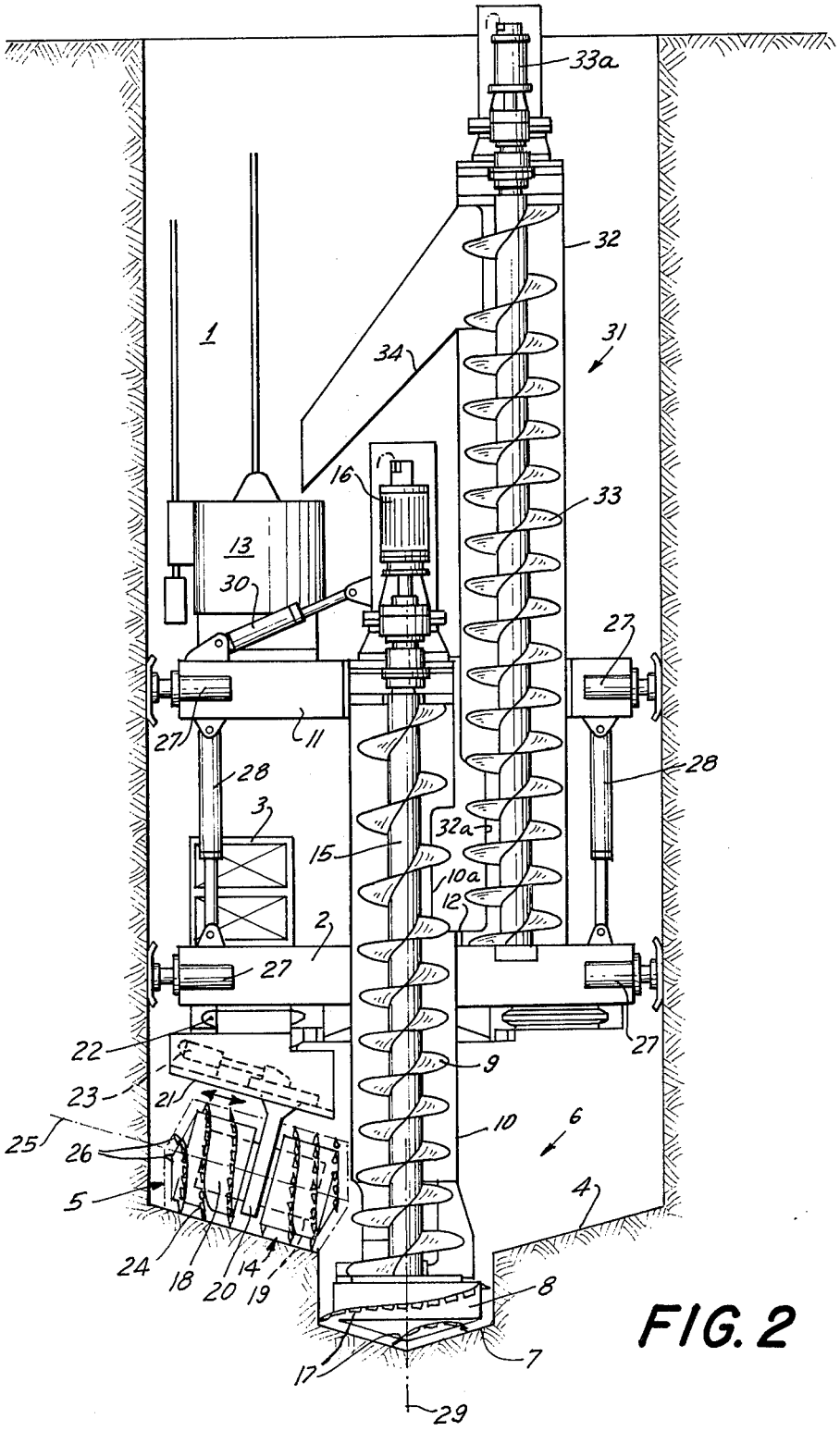
FIG. 2 is a view similar to FIG. 1, in which similar reference numerals refer to similarly functioning parts, of a second embodiment of the invention.
Figure 3:
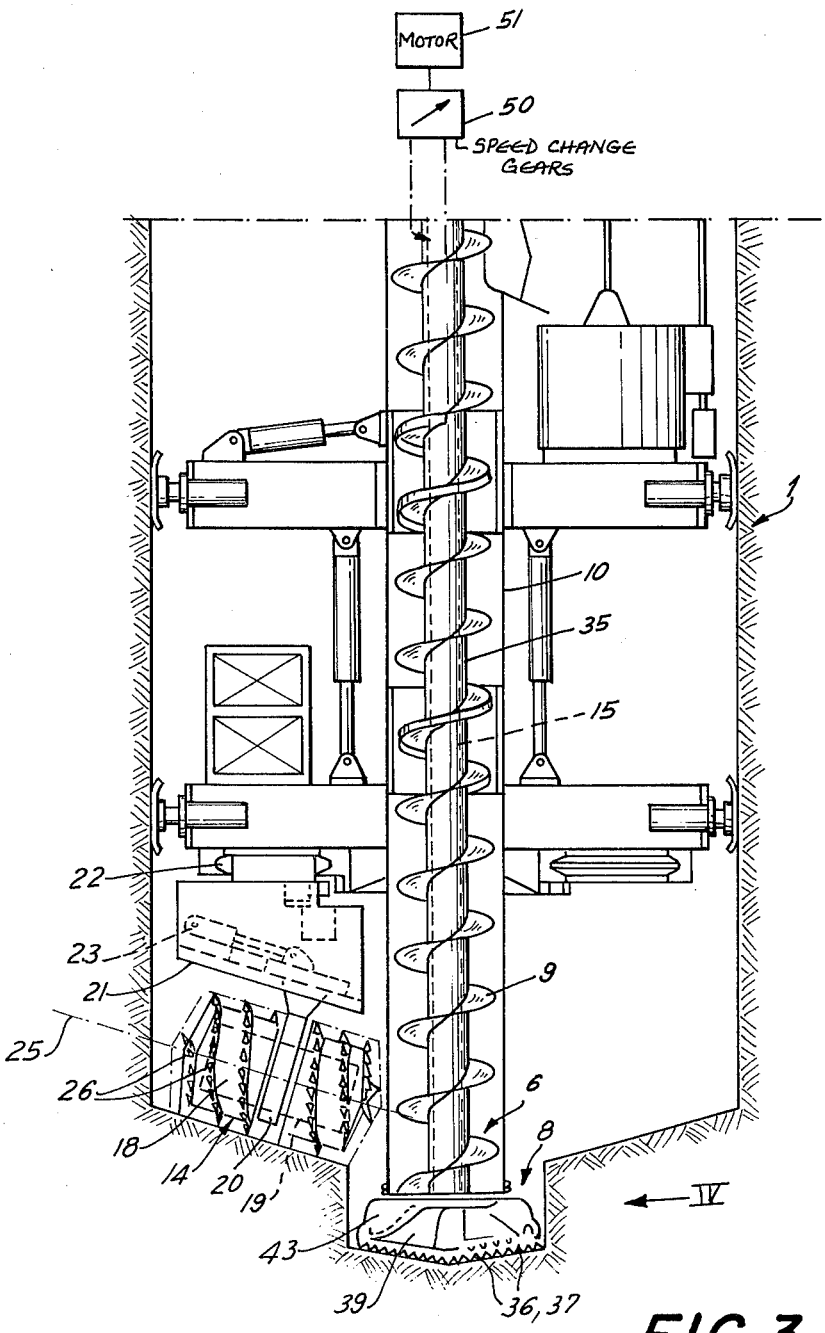
FIG. 3 is a view similar to FIG. 1 but illustrating yet another embodiment of the invention.

In the embodiments of the present invention illustrated in FIGS. 1 through 3, the cutter tool 14 comprises a drum 18 within which the drum drive is provided at 19 to rotate the drum about its axis 25.

The drum 18 is, in turn, rotatable upon an outrigger arm 20 which is guided on a slide 21 via its carriage 21', the guide 21, in turn, being mounted on a carriage **21*a* which is provided with a drive 21*b* whose pinion wheel (not shown) can mesh with a ring gear surrounding the tube 10 and also formed on the underside of the platform 2. A track 21*c* for the carriage 21*a* surrounds the axis 29 so that the drive 21*b* can propel the carriage 21*a* in an orbit path about the axis 29. A cylinder arrangement 23 and the guide 22 formed by the track 21*c*, ensure that the cutting tool 14 will orbit the axis 29 to cut away the full face 4 of the shaft while the cutter 14 is reciprocated radially as represented by the arrow 14' so that the full radial width of the face is cut away. To this end, the cylinder 23 can have its piston anchored to the carriage 21'**.

As noted earlier, the picks or teeth of the drum 14 are provided on a tool carrier 24 which is formed with a helical or worm configuration to act as a conveyor feeding the detritus into the bore 7. For the same purpose, the axis 25 of the tool 14 is inclined to the axis 29 of the shaft downwardly and inwardly. At the outer end face of the drum 14, there are provided additional tools or picks 26 which enable the tool 14 to correct or alter the diameter of the shaft by milling away the vertical wall thereof. The apparatus thus is suitable for sinking shafts of different diameters or varying the diameter of a given shaft along its depth.

The machine platform 2 and the loading platform 11 are braced against the vertical wall of the shaft by anchoring or clamping piston-and-cylinder arrangements represented diagrammatically at 27 and terminating in shoes 27' which engage this wall. The cylinder arrangements 27 are angularly equispaced about the periphery of the shaft and bear radially outwardly upon the wall.

In addition, the loading platform can be supported by a plurality of angularly equispaced vertical feed cylinder arrangements 28 on the machine platform. Thus, for example, with loading platform 11 anchored against the wall, the cylinder arrangement 27 of the machine platform 2 can be retracted for sinking of the shaft by extension of the cylinder arrangements 28 whereupon the cylinder arrangements 28 can be retracted with bracing of platform 2 and retraction of the cylinder arrangements 27 of the loading platform 11.

The boring unit 6 is surrounded with play or clearance by the loading platform 11 so that, upon anchoring of the loading platform 11 against the vertical wall and release of the cylinder arrangements 27 of the machine platform from the wall, the latter cam be lowered by means of the feed cylinder arrangement 28. This allows the shaft sinking force to be generated or to be adjusted.

The positioning of the boring unit 6 with respect to the shaft axis 29 is effected or corrected by means of control cylinders 30 which can also be angularly equispaced about the shaft axis and only one of which has been shown in FIG. 1. The control cylinders 30 can be pivotally connected to the loading platform 11 and to the conveyor tube 10.

The embodiment of FIG. 2 differs from that of FIG. 1 in that the main platform 2 carries a further conveyor unit 31 having an upright conveyor tube 32 and a worm 33 offset from the axis 29 and hence eccentric to the boring unit 6. The conveyor unit 31 passes with clearance through the loading platform 11.

In this embodiment, the conveyor tube 10 opens laterally at **10*a* into an opening 32*a* of the conveyor tube 32 which is formed with a chute 34 dumping the detritus into the bucket 13. A separate drive motor 33*a* is provided for the additional conveyor worm 33 at the top of the conveyor tube 32. This system, therefore, differs from that of FIG. 1 in providing a two-stage displacement of the detritus from the floor of the shaft to the bucket. Since the conveyor unit 31 is fixed on the platform 2 and passes with play through the platform 11, the overall length of the conveyor tube 10 can be less, thereby reducing the height of the structure which must be adjusted by cylinders 30**.

Figure 4:
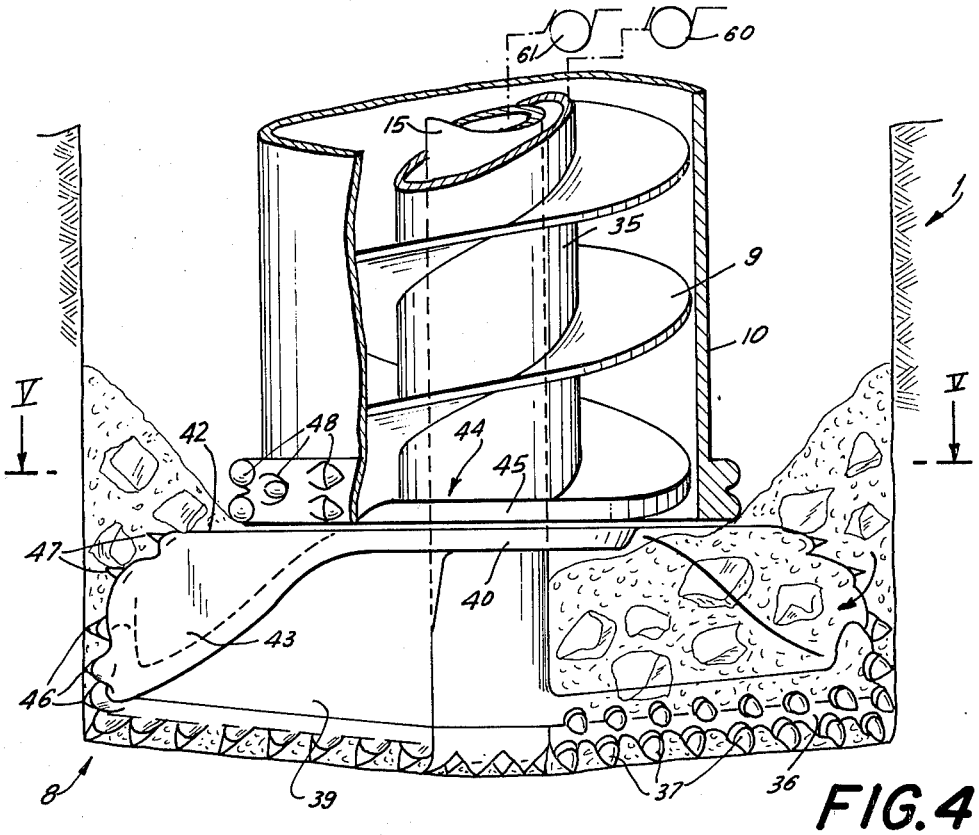
FIG. 4 is a diagrammatic enlarged detailed view of the region IV of FIG. 3.
Figure 5:
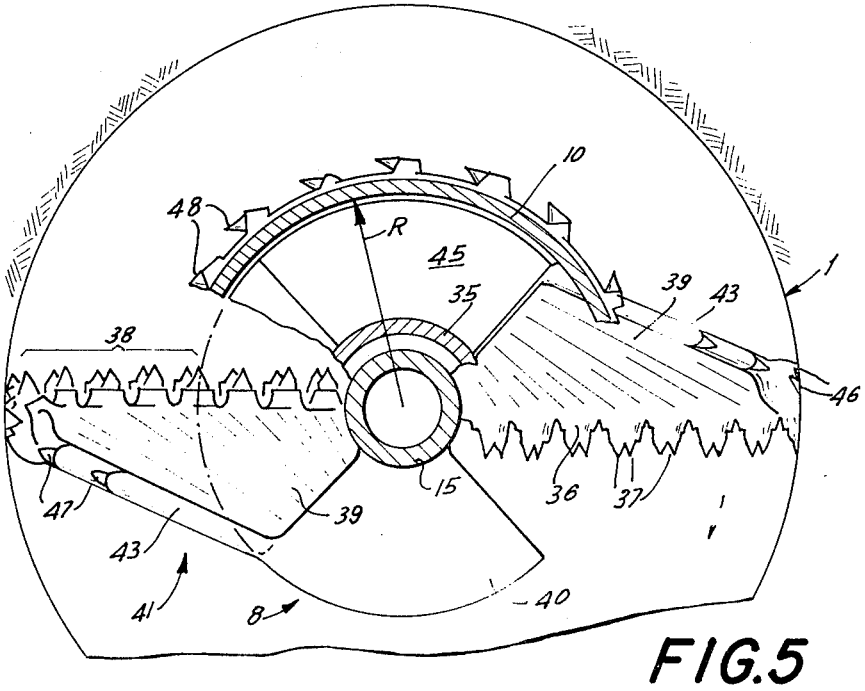
FIG. 5 is a partial cross-sectional view taken along the line V—V of FIG. 4.

FIGS. 3 through 5 relate to the pilot-boring assembly in greater detail, this assembly being suitable for use with either the system of FIG. 1 or the system of FIG. 2. In this specific construction, the pilot-bore head is mounted at the base of the shaft 15 and is associated with the conveyor 9, 10 mentioned previously.

The pilot-bore head 8 is formed as a milling cutter for rotary boring and is mounted at the base of the pilot-bore shaft 15 driven by an assembly 16 as described in connection with FIG. 1. The conveyor arrangement is here provided by a wall 9 rotatable in a conveyor tube 10 but formed on a hollow shaft 35 which surrounds the pilot-bore head shaft and which can be rotated at an angular velocity different from that of shaft 35 but preferably in the same sense. The head 8 is provided with cutting tools which simultaneously form conveyor scoops or flights.

From FIGS. 4 and 5, more particularly, it can be seen that the head 8 has at least two substantially radial angularly equispaced pick carriers 36 upon which the individual milling picks 37 are mounted, the picks projecting beyond the periphery of the conveyor tube 10 over a free region 38. The conveyor flights are formed on the one hand by the pick carriers 36 and, on the other hand, by scoop plates 39 connected to the pilot-bore head shaft 15. The scoop plates 39 rise, more or less in helical fashion, toward the pilot-bore shaft 15 and extend, in the region of the pilot-bore shaft 15 into a substantially horizontal platform segment 40 which lies directly (axially) below the opening to the conveyor tube 10. Along their picks 41 the scoops 39 are closed by upwardly extending flanges or edge walls 43 which rise until their upper edges are spaced just below the lower edge of the downwardly open mouth of the conveyor tube 10. This wall decreases in height inwardly toward the hollow shaft 35.

The worm 9 at its lower end 44 is formed with a substantially horizontal pickup scoop 45 which is spaced only slightly above the platform segments 40.

While for convenience of illustration, the conveyor 9 is shown to have a single flight, i.e. is a single helix, in practice the conveyor will usually be a double or multiple flight or a multihelix arrangement.

According to the invention, moreover, the pick carrier 36 is formed with downwardly inclined picks 37 while peripheral picks 46 are likewise provided on the carrier. To comminute large pieces, the aforementioned wall is provided along its periphery with further picks 47 which perform a grinding role.

The aforedescribed arrangement of the picks 37, 46, 47 has been found to bring about an effective comminution of the detritus so that it enters the conveyor system practically in a frictionless manner and passes radially therealong.

It has been found to be advantageous for this purpose to ensure that a free length of picks along each pick carrier 36 beyond the radius R of the conveyor tube 10 is provided as represented at 38 and as has been previously mentioned.

The flow of the detritus and its transfer from the head 8 to the wall 9 is especially advantageous when the wall 43 connected to the scoop plate 39 is inclined opposite to the direction of rotation slightly upwardly. The breakup of the detritus produced by the tool 14 and fed to the hole 7 can be improved still further by providing additional picks 48 along the lower edge of the conveyor tube 10.

The wall 9 is rotated with a speed ensuring the movement of the detritus out of the hole 7 while the head 8 is driven with a speed ensuring the sinking of the hole 7 and at the same time the effective transfer of the detritus from tool 14 and from the head 8 to the pickup scoop or scoops 45 with a minimum of energy loss and abrasion or comminution at this scoop.

It has also been found to be advantageous, in some cases to step the diameter of the milling tool 14 or to reduce its diameter outwardly so that in the region of the shaft wall a peripheral step remains at the floor of the shaft.

Naturally, while the system of the present invention is fully operative for the dry excavation of a shaft, it is possible inwardly of the peripheral step and in the region of the pilot-bore to supply a fluid which facilitates in clayey strata, the formation of an emulsion which can be pumped away. The apparatus of the present invention is also effective for frozen-ground shaft sinking.

We claim:

1. An apparatus for sinking a shaft which comprises:

a main platform adapted to be positioned in an excavation above a floor to be cut away to sink a shaft;

a pilot bore unit mounted on said main platform and provided with:

a pilot bore head adapted to sink a pilot bore centrally in said floor, and a worm conveyor connected to said head and extending upwardly therefrom through said platform for conveying detritus from the pilot bore formed by said head away therefrom, said worm conveyor including an upwardly extending tube opening at said head and a worm rotatable in said tube for elevating detritus therethrough, said worm being adjacent said head;

a milling drum mounted on said main platform laterally over and above said head and provided internally with a drive for milling away said floor around said pilot bore and transferring detritus to said conveyor, said head being formed with a cutting drum and a multiplicity of cutters arranged in a conveyor flight to feed detritus to said tube;

means on said main platform or orbiting said milling drum around said pilot bore unit; and a loading platform spaced above said main platform and provided with transport means for carrying detritus away from said excavation, said worm conveyor reaching upwardly towards the loading platform for transferring detritus to said transport means, said milling drum being formed with teeth disposed in a worm pattern inducing detritus to move to said pilot bore.

2. The apparatus defined in claim 1 wherein said conveyor includes a worm and a conveyor tube surrounding said worm and passes with clearance through said loading platform, said tube being provided above said loading platform with a chute for transferring detritus to said transport means.

3. The apparatus defined in claim 1 wherein said conveyor communicates with a further worm conveyor mounted on said main platform and passing with clearance through said loading platform, said further conveyor transferring detritus to said transport means.

4. The apparatus defined in claim 1 wherein said pilot-bore unit further comprises a pilot-bore head shaft connected to said head and a drive for said shaft remote from said head.

5. The apparatus defined in claim 4 wherein said worm is formed on said shaft.

6. The apparatus defined in claim 4 wherein said conveyor comprises a hollow shaft surrounding said pilot shaft and formed with said worm, said shafts being drivable at different speeds.

7. The apparatus defined in claim 6, further comprising separate drives for said shafts.

8. The apparatus defined in claim 6, further comprising a common drive for said shafts including respective speed-setting transmissions between said common drive and each shaft.

9. The apparatus defined in claim 1 wherein at least two angularly equispaced substantially radial tool carriers are provided as respective flights of said head, each of said flights being provided with a row of picks, each row of picks projecting outwardly beyond the periphery of said tube, said flights being formed with scoop-shaped ramps running from the respective row of picks upwardly to substantially horizontal platform segments, each of said ramps having a rear wall with respect to the direction of rotation converging inwardly and terminating in an edge lying immediately below the lower edge of said tube, said worm being formed at its lower end with a scoop lying immediately above said platform segments.

10. The apparatus defined in claim 9 wherein said picks are inclined downwardly and upwardly, said wall being formed at its outermost portion with laterally projecting picks.

11. The apparatus defined in claim 10 wherein the lower edge of said tube is provided with outwardly projecting picks.

12. The apparatus defined in claim 1 wherein said milling drum is rotatable on an outrigger radially shiftable on a carriage, said main platform being further provided with a circumferential guide for said carriage enabling said milling drum to orbit said pilot-bore unit.

13. The apparatus defined in claim 12 wherein said carriage has a drive exclusively orbiting said milling drum about said pilot-bore unit.

14. The apparatus defined in claim 1 wherein each of said platforms is provided with respective fluid-responsive cylinders enabling said platforms to be individually anchored to a vertical wall of the shaft, said apparatus further comprising hydraulic cylinders connecting said platforms for relatively displacing same along the axis of said shaft.

* * * * *